US005173042A

United States Patent [19]

Chambers

[11] Patent Number: 5,173,042

[45] Date of Patent: Dec. 22, 1992

[54] SCROLL COMPRESSOR AND DISCHARGE VALVE

[75] Inventor: Dale T. Chambers, Dayton, Ohio

[73] Assignee: General Motors Corporation, Detroit, Mich.

[21] Appl. No.: 787,845

[22] Filed: Nov. 4, 1991

[51] Int. Cl.[5] ..... F04C 18/04; F16K 15/00

[52] U.S. Cl. ..... 418/55.1; 418/270; 137/543.19

[58] Field of Search ..... 418/55.1, 270; 137/543.19, 543.21

[56] References Cited

U.S. PATENT DOCUMENTS

| | | | |
|---|---|---|---|
| 48,377 | 6/1865 | Day | 137/543.21 |
| 4,300,875 | 11/1981 | Fischer et al. | 418/56 |
| 4,332,535 | 6/1982 | Terauchi et al. | 418/94 |
| 4,457,675 | 7/1984 | Inagaki et al. | 418/14 |
| 4,468,181 | 8/1984 | Sakamoto | 418/55.3 |
| 4,474,543 | 10/1984 | Kiraga et al. | 418/55.3 |
| 4,477,239 | 10/1984 | Yoshii et al. | 418/55.2 |
| 4,492,543 | 1/1985 | Iimori et al. | 418/55.3 |
| 4,571,163 | 1/1986 | Sakamoto et al. | 418/55.1 |
| 4,597,724 | 7/1986 | Sato et al. | 418/57 |
| 4,815,493 | 3/1989 | Miller et al. | 137/543.19 |
| 4,865,530 | 9/1989 | Nishida et al. | 418/55.6 |
| 4,904,165 | 2/1990 | Fraser, Jr. et al. | 418/55.1 |

FOREIGN PATENT DOCUMENTS

| | | | |
|---|---|---|---|
| 58-62397 | 4/1983 | Japan | 418/55.1 |
| 59-119080 | 7/1984 | Japan | 418/55.1 |
| 63-239391 | 10/1988 | Japan | 418/55.1 |
| 2-163486 | 6/1990 | Japan | 418/55.1 |

*Primary Examiner*—John J. Vrablik

*Attorney, Agent, or Firm*—Ronald L. Phillips

[57] ABSTRACT

A scroll type fluid compressor 10 has a housing 12 including a front section 14 and a rear section 16, an inlet port 112 and an outlet port 114. The rear section 16 of the housing includes an integral fixed scroll 18 with a discharge aperture 90 in the center and an integral exhaust cavity 88. A one way discharge valve 92 including a tubular valve body 95 is pressed into the scroll discharge aperture 90, extends across the exhaust cavity and has one end received in a recess 94 in a boss 96 on a wall of the exhaust cavity 88. An orbital scroll 24 is driven in an orbital path by a crank shaft 74 and cooperates with the fixed scroll 18 to compress fluid. An axial thrust and rotation prevention assembly 46 prevents rotation of the orbital scroll.

3 Claims, 2 Drawing Sheets

SCROLL COMPRESSOR AND DISCHARGE VALVE

DESCRIPTION

1. Technical Field

The invention relates to a fluid displacement apparatus and more particularly to a scroll type compressor. Scroll type compressors are commonly used to compress refrigerant in stationary and mobil air conditioning systems.

2. Background Of The Invention

Scroll type compressors with one stationary scroll and one orbiting scroll are well known. Scrolls in these compressors have parallel end plates and involute spiral wrap elements of like pitch. The wrap of one scroll makes line contacts with the wrap of the other scroll and also contacts the adjacent end plate to define fluid pockets. As the orbital scroll orbits relative to the fixed scroll, the locations of the contact lines move along the surfaces of the wraps toward the center of the scrolls, the pockets decrease in size compressing the fluid contained in the pockets and the fluid is moved toward the center of the scrolls. A scroll discharge aperture is provided near the center of the fixed scroll to allow compressed fluid to pass from the scrolls into an exhaust cavity. The exhaust cavity receives compressed fluid from the scrolls, reduces or eliminates pressure fluctuations and muffles noise produced by the scrolls. Exhaust cavities are commonly formed by attaching a casting with one open side to the rear wall of the fixed scroll.

To eliminate the possibility of the reverse flow of compressed fluid from the exhaust cavity through the scroll discharge opening and into scroll pockets, it is common to place a reed valve over the scroll discharge opening inside the exhaust cavity. It is also known to use a spring biased sliding plug on a guide pin as a check valve. These valves are assembled and serviced with the casting forming the exhaust cavity removed from the back of the stationary scroll.

The fixed scroll and the orbital scroll must be properly positioned relative to each other. The wraps are angularly and radially offset relative to each other so that the line contacts between the wraps seal off the fluid pockets. A stationary scroll which is manufactured as a separate part from the compressor housing will vary in angular and radial position with the housing. This variance complicates manufacture and results in less than ideal sealing at the contact lines between wraps.

SUMMARY OF THE INVENTION

A primary object of this invention is to provide a scroll compressor with improved efficiency, reduced manufacturing cost and increased durability.

Another object of the invention is to provide a scroll compressor with an integral housing rear section and fixed scroll.

A further object of the invention is to provide an exhaust cavity that is an integral part of the housing rear section and the fixed scroll.

A still further object of the invention is to provide a check valve that is pressed into the scroll discharge aperture.

The scroll compressor according to the present invention includes a housing with a front section and a rear section. A fixed scroll with a flat end plate and an involute spiral wrap is an integral portion of the rear section of the housing. A orbital scroll with a flat end plate and an involute spiral wrap is positioned inside the housing in an angularly and radially offset position relative to the fixed scroll to form at least one pair of fluid pockets. A crankshaft assembly is rotatably journaled in the front section of the housing and is operatively connected to the orbital scroll to drive the orbital scroll. The orbital scroll is driven relative to the fixed scroll by the crankshaft to move the fluid pockets toward the center of the scrolls and compress the fluid in the pockets.

An axial thrust and rotation preventing assembly is mounted in the front section of the housing. The assembly includes a plurality of balls which axially position the orbital scroll relative to the fixed scroll to maintain a seal between the axial end surface of each wrap and the flat end plate of the adjacent scroll. The balls which transfer an axial thrust load on the orbital scroll to the housing are each positioned in one of the apertures in a ring attached to the front section of the housing and a ring attached to the orbital scroll. The apertures in the two rings have the proper diameter relative to the balls and the radius of the orbital scroll orbit to permit orbital movement of the orbital scroll and to prevent rotation of the orbital scroll.

An exhaust cavity is an integral part of the housing rear section and the fixed scroll. A scroll discharge aperture is provided in the scroll end plate for the passage of compressed fluid from the scrolls to the exhaust cavity.

A check valve with a tubular valve body is positioned in the scroll discharge aperture. The check valve allows fluid to pass from the scrolls into the exhaust cavity and prevents reverse flow. An interference fit is provided between the tubular valve body and the scroll discharge aperture to retain the valve body within the exhaust cavity. The valve body may also be retained in a bore in a boss on the wall of the exhaust cavity opposite the scroll discharge aperture. The check valve is pressed into the exhaust cavity from the wrap side of the fixed scroll during manufacture.

The foregoing and other objects, features and advantages of the present invention will become apparent in the light of the following detailed description of exemplary embodiments thereof, and as illustrated in the accompanying drawing.

DETAILED DESCRIPTION OF THE INVENTION

Figure 1:
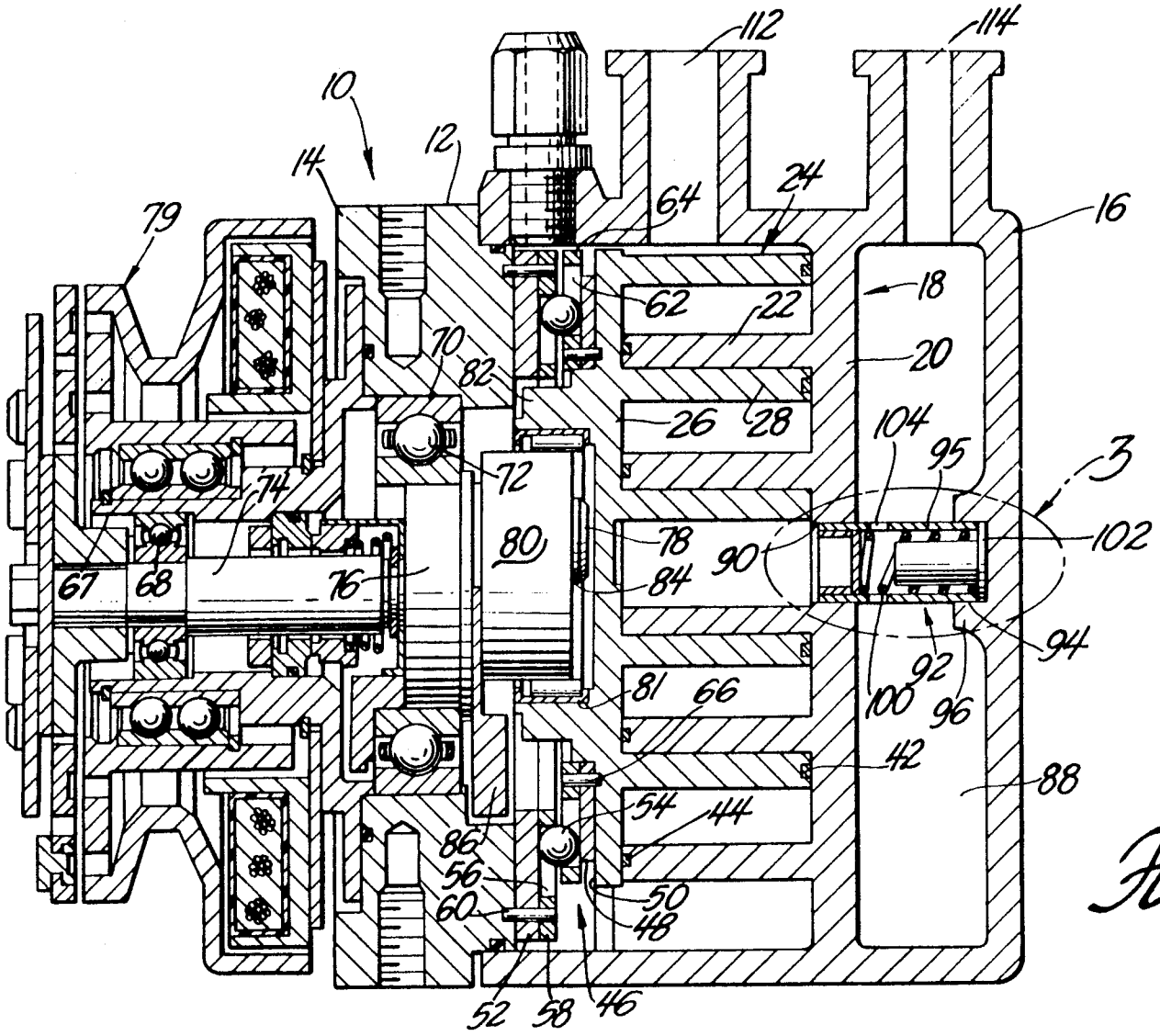
FIG. 1 is a vertical sectional view of a scroll compressor with an exhaust cavity and a discharge check valve according to an embodiment of this invention.

The scroll type compressor 10 as shown in FIG. 1 includes a housing 12 with a front section 14 and a rear section 16. The two sections are held together by bolts that are not shown.

A fixed scroll 18 is an integral portion of the rear section 16 of the housing. The fixed scroll 18 includes a flat end plate 20 and an involute spiral wrap 22. An orbital scroll 24 is positioned within the housing 12 to cooperate with the fixed scroll 18. The orbital scroll 24 includes a flat end plate 26 and an involute spiral wrap 28. The wrap side surface of the flat end plate 20 is parallel to the wrap side surface of flat end plate 26.

Figure 2:
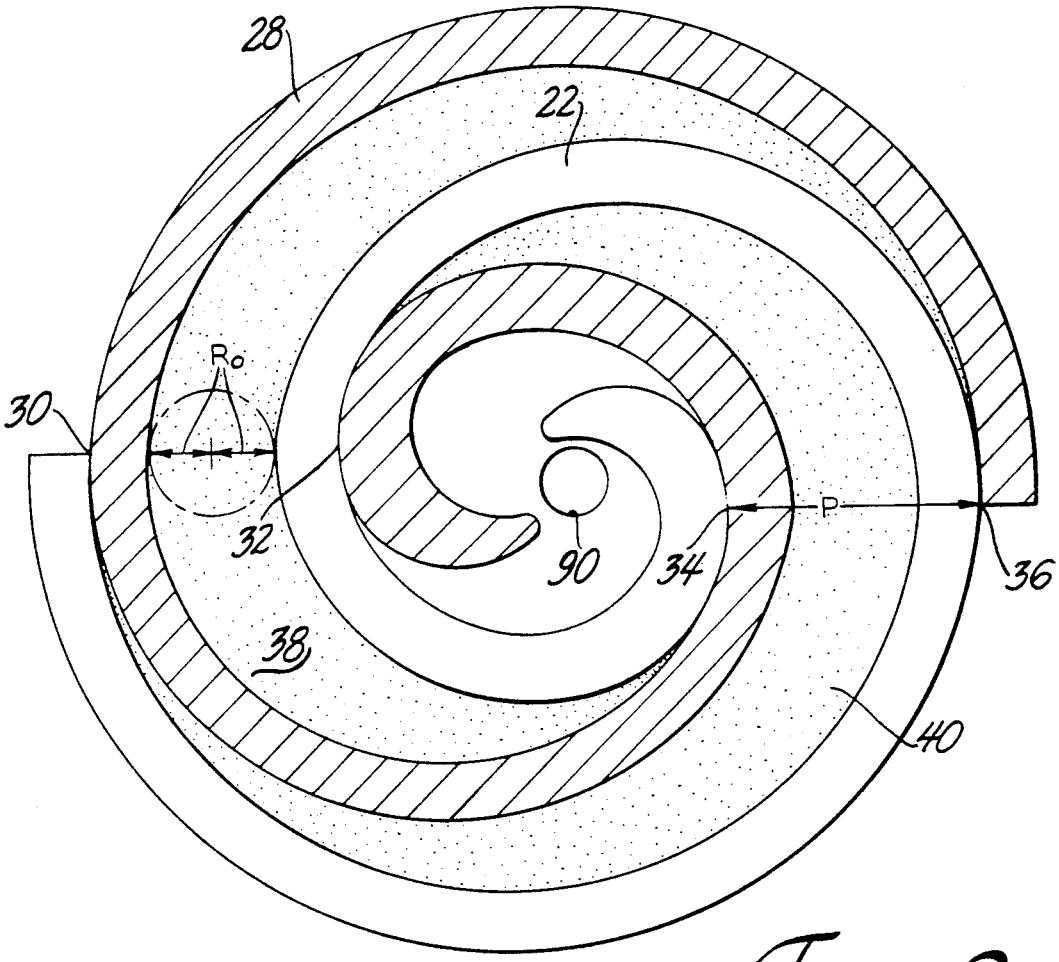
FIG. 2 is a diagrammatic sectional view illustrating the spiral elements of the fixed and orbiting scrolls.
Figure 3:
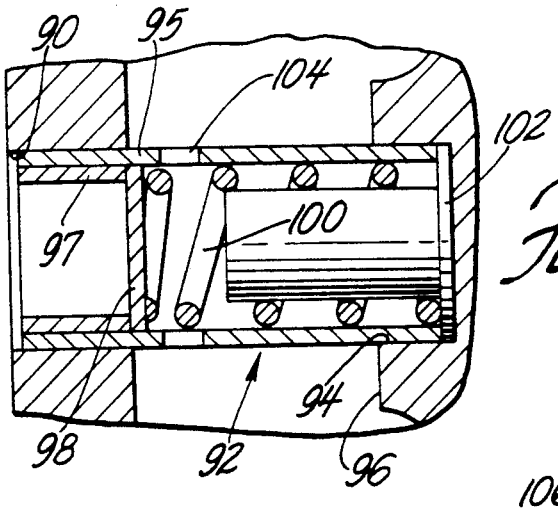
FIG. 3 is an enlarged cross sectional view of the fixed scroll exhaust cavity and discharge check valve of FIG. 1.

The involute spiral wrap 22 of fixed scroll 18 has the same pitch P as the involute spiral wrap 28 of orbital scroll 24. The involute spiral wraps 22 and 28 are in contact with each other along lines perpendicular to the flat end plates 20 and 26. Locations of the contact lines 30, 32, 34 and 36, when the scrolls are in one position relative to each other, are shown in FIG. 2. The contacts between the involute spiral wraps 22 and 28 and between the axial ends of the involute spiral wraps and the flat end plates 20 and 26 form sealed pockets 38 and 40. When the orbital scroll 24 orbits in a counter clockwise direction, as seen in FIG. 2, the contact lines 30, 32, 34 and 38 move counter clockwise along the surfaces of the involute spiral wraps 22 and 28 and the sealed pockets 38 and 40 move toward the center of the scrolls 18 and 24. As the sealed pockets 38 and 40 move toward the center of the scrolls 18 and 24 the pockets become smaller and the fluid in the pockets is compressed.

The involute spiral wraps 22 and 28 include seals 42 in grooves 44 in the axial end surfaces of each involute spiral wrap. To keep the seals 42 in sealing contact with the flat end plates 20 and 26 of the adjacent scroll 18 or 24 and to prevent axial separation of the scrolls due to the force exerted on end plates by compressing fluid in the sealed pockets 38 and 40, axial thrust loads applied to the orbital scroll 24 are transferred to the housing 12 by an axial thrust and rotation preventing assembly 46. The axial thrust and rotation prevention assembly 46 includes a flat ring race 48 secured to a forward surface 50 of the orbital scroll 24 and a flat ring race 52 secured to front section 14 of the housing 12. A number of balls 54 are provided between the flat ring races 48 and 52. These balls 54 transfer axial thrust loads on the orbital scroll 24 to the housing 12 and maintain the seals 42 in sealing contact with the adjacent scroll flat end plate 20 or 26. At least three balls 54 are required. It is common to employ about sixteen balls 54 in each axial thrust and rotation prevention assembly 46.

The balls 54 are each in an aperture 56 in a ring 58 secured to the compressor housing 12 by pins 60. The balls 54 are also each in an aperture 62 in a ring 64 secured to the orbital scroll 24 by pins 66. The apertures 56 in the ring 58 and the apertures 62 in ring 64 are the same diameter. The diameter of the apertures 56 is sufficient to permit orbital movement of the orbital scroll 24 in a path that will maintain contact between the involute spiral wraps 22 and 28. The balls 54 cooperate with the walls of the apertures 56 and 62 in the rings 58 and 64 to prevent rotation of the orbital scroll 24.

The front section 14 of the housing 12 includes bore 67 for bearing 68 and a bore 70 for bearing 72. The bores 67 and 70 are co-axial. A crankshaft 74 with an integral disk 76 is rotatably journaled in the housing 12 by the bearings 68 and 72. A crank pin 78 is an integral part of the disk 76 and the crankshaft 74. An end of the crankshaft 74 extends outside the compressor housing 12 and has a belt pulley 79 or other drive means attached.

An eccentric bushing 80 is rotatably journaled by a needle bearing 81 in a boss 82 on the forward surface 50 of the orbital scroll 24. The crank pin 78 passes through a bore in the eccentric bushing 80. A retainer clip 84 secures the bushing 80 to the crank pin 78. A balance weight 86 is secured to the eccentric bushing 80.

The rear section 16 of the compressor housing 12 includes an integral exhaust cavity 88. A scroll discharge aperture 90 is provided in the center portion of the flat end plate 20 for the passage of compressed fluid from the scrolls 18 and 24 into the integral exhaust cavity 88. A check valve 92 is positioned in the scroll discharge aperture 90 and in a bore 94 in a boss 96 on a wall of the integral exhaust cavity 88 across from the scroll discharge aperture 90.

The check valve 92 includes a tubular body 95, a valve seat 97, a valve plate 98, a compression spring 100 and an end cap 102. The check valve 92 is pressed into the discharge aperture 90 from the side of the fixed scroll 18 with the involute spiral wrap 22. The tubular body 95 of the check valve 92 extends across the integral exhaust cavity 88 and into the bore 94 in the boss 96. An interference fit is provided between the tabular body 95 and the scroll discharge aperture 90 and the bore 94 in the boss 96. The valve plate 98 and the end cap 102 are preferably steel to eliminate wear. The tubular body 95 and the valve seat 97 may be aluminum. Discharge openings 104 are provided in the tubular body 95.

Figure 4:
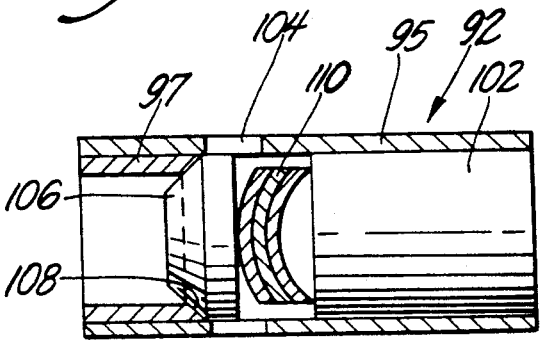
FIG. 4 is a cross sectional view of an alternate check valve construction.

An alternate form of the check valve 92 is shown in FIG. 4. This valve has a beveled torlon valve plate 106, an aluminum valve seat 97 with a beveled surface 108 to mate with the beveled torlon valve plate 106 and curved disk springs 110 in place of the coiled compression spring 100.

In operation, the crankshaft 74 is rotated by an outside power source. The crankshaft 74 rotates the eccentric bushing 80 to orbit the orbital scroll 24. The sealed pockets 38 and 40, formed by the scrolls 18 and 24, receive fluid which enters the compressor housing 12 through an inlet port 112. As the orbital scroll 24 continues to orbit the fluid is moved toward the center of the scrolls 18 and 24 and compressed. The compressed fluid lifts the valve plate 98 or 106 from the valve seat 97 and compresses the spring 100 or 110 in the check valve 92 and passes through the discharge openings 104 in the tubular body 95 and into the integral exhaust cavity 88. Compressed fluid flows out of the exhaust cavity 88 and the compressor housing 12 through an outlet port 114.

The invention has been described in detail in connection with preferred embodiments. It will be understood by those skilled in the art that the invention can be used in pumps as well as compressors and that other variations and modifications can be made which are within the scope of the invention.

I claim:

1. A scroll type fluid compressor having a housing with a front section and a rear section; a fluid inlet in the housing; a fluid outlet in the housing; a fixed scroll integral with the housing rear section; in one piece an orbital scroll cooperating with the fixed scroll to form fluid pockets; a rotation prevention assembly which permits orbital movement and prohibits rotation of the orbital scroll; a driven crankshaft rotatably journaled in the housing front section and connected to the orbital scroll and operable to move the orbital scroll in an orbital path, move the fluid pockets toward the center of the scrolls and compress the fluid in the pockets; the integral one piece housing rear section and fixed scroll including an integral enclosed exhaust cavity and a scroll discharge aperture near the center of the fixed scroll connecting the region at the center of the two scrolls with the integral enclosed exhaust cavity; a one way discharge valve including a tubular valve body pressed into the scroll discharge aperture from the side of the fixed scroll end plate that faces the orbital scroll unit, the value being out of the orbital path of the orbital scroll and extending into the exhaust cavity, a valve seat mounted in the tubular valve body, a valve plate seated on the valve seat, a spring to bias the valve plate toward the valve seat, at least one radial port in the tubular body operable to allow the passage of fluid from the scrolls to the exhaust cavity when the valve plate is forced off the valve seat by compressed fluid in the scrolls; and wherein the fluid outlet port in the housing is in a wall of the exhaust cavity.

2. A scroll type fluid compressor having a housing with a front section and a rear section; a fluid inlet in the housing; a fluid outlet in the housing; a fixed scroll with an end plate and an involute wrap in the housing; an orbital scroll with an end plate and an involute wrap cooperating with the fixed scroll to form fluid pockets; a rotation prevention assembly which permits orbital movement and prohibits rotation of the orbital scroll relative to the housing; a driven crankshaft rotatably journaled in the housing front section and connected to the orbital scroll and operable to move the orbital scroll in an orbital path, move the fluid pockets toward the center of the scrolls and compress the fluid in the pockets; a scroll discharge aperture near the center of the fixed scroll; an exhaust cavity in the rear section of the housing in communication with the scroll discharge aperture; a boss on an inside wall of the exhaust cavity and a recess in the boss in axial alignment with the scroll discharge aperture; a one way discharge valve with a tubular valve body mounted in the scroll discharge aperture and in the recess in the boss inside the exhaust cavity, and a fluid discharge port in the tubular body between the fixed scroll end plate and the boss on an inside wall of the exhaust cavity; and wherein the fluid outlet in the housing is in communication with the exhaust cavity.

3. A scroll type fluid compressor having a housing with a front section and a rear section; a fluid inlet in the housing; a fluid outlet in the housing; a fixed scroll with an end plate and an involute wrap integral with the housing rear section in one piece; an orbital scroll with an end plate and an involute wrap cooperating with the fixed scroll to form fluid pockets; a rotation prevention assembly which permits orbital movement and prohibits rotation of the orbital scroll; a driven crankshaft rotatably journaled in the housing front section and connected to the orbital scroll and operable to move the orbital scroll in an orbital path, move the fluid pockets toward the center of the scrolls and compress the fluid in the pockets; the integral one piece housing rear section and fixed scroll including an integral enclosed exhaust cavity one wall of which is the fixed scroll end plate, a scroll discharge aperture near the center of the fixed scroll end plate connecting the region at the center of the two scrolls with the integral enclosed exhaust cavity and a boss with a recess on an inside wall of the integral enclosed exhaust cavity opposite the fixed scroll end plate; a one way discharge valve including a tubular valve body pressed into the scroll discharge aperture from the side of the fixed scroll facing the orbital scroll and extending across the exhaust cavity and into the recess in the boss on the inside wall of the integral enclosed exhaust cavity; a valve seat mounted in the tubular valve body, a valve plate seated on the valve seat, a radial port in the tubular body between the fixed scroll end plate and the boss on an inside wall of the integral enclosed exhaust cavity operable to allow the passage of fluid from the scrolls to the exhaust cavity when the valve plate is forced off the valve seat by compressed fluid in the scrolls; and wherein the fluid outlet in the housing is in a wall of the exhaust cavity remote from said boss.

* * * * *